US007438009B2

(12) United States Patent
Grant

(10) Patent No.: US 7,438,009 B2
(45) Date of Patent: Oct. 21, 2008

(54) SEWING MACHINE CLUTCH WITH REMOVABLE LOCKING PIN

(75) Inventor: Matthew M. Grant, Churubusco, IN (US)

(73) Assignee: Sailrite Enterprises, Inc., Churusbusco, IN (US)

( * ) Notice: Subject to any disclaimer, the term of this patent is extended or adjusted under 35 U.S.C. 154(b) by 0 days.

(21) Appl. No.: 11/881,331

(22) Filed: Jul. 26, 2007

(65) Prior Publication Data

US 2008/0022909 A1 Jan. 31, 2008

Related U.S. Application Data

(60) Provisional application No. 60/820,427, filed on Jul. 26, 2006.

(51) Int. Cl.
*D05B 69/34* (2006.01)
*D05B 69/00* (2006.01)

(52) U.S. Cl. ..... 112/283

(58) Field of Classification Search ..... 112/220, 112/217.3, 283, 258; 137/385, 158, 384.2; 74/10.2; 192/71, 69.61, 69.7, 69.6
See application file for complete search history.

(56) References Cited

U.S. PATENT DOCUMENTS

| | | | | | |
|---|---|---|---|---|---|
| 194,067 | A | * | 8/1877 | Baker et al. | 192/71 |
| 241,180 | A | * | 5/1881 | Barker | 192/69.61 |
| 247,398 | A | * | 9/1881 | Parcelle | 192/76 |
| 1,853,110 | A | * | 4/1932 | Ball | 188/69 |
| 3,224,398 | A | * | 12/1965 | Greulich | 112/220 |
| 3,869,030 | A | * | 3/1975 | Masaki | 192/69.61 |
| 4,453,624 | A | * | 6/1984 | Graham | 192/69.7 |
| 4,523,794 | A | * | 6/1985 | Peterman | 312/201 |
| 5,148,754 | A | * | 9/1992 | Lahti et al. | 105/96 |

* cited by examiner

*Primary Examiner*—Ismael Izaguirre
(74) *Attorney, Agent, or Firm*—Wood, Phillips, Katz, Clark & Mortimer

(57) ABSTRACT

A sewing machine having a locking pin clutch mechanism allowing the user to selectively engage the flywheel or balance wheel for transmitting power to the main drive shaft. The locking pin may also have a line of weakness to function as a shear pin. The locking pin may be removable from the flywheel, and the flywheel retaining locking knob may include an aperture for storing the locking pin. In alternate embodiments, the locking pin may be held captive in the flywheel when the clutch is disengaged.

23 Claims, 6 Drawing Sheets

SEWING MACHINE CLUTCH WITH REMOVABLE LOCKING PIN

RELATED APPLICATIONS

This application claims priority to U.S. Provisional application 60/820,427, entitled Sewing Machine Clutch with Removable Locking Pin, filed on Jul. 26, 2006. The aforementioned application is incorporated herein by reference.

FIELD OF THE INVENTION

This invention relates to the field of sewing machines, and more generally to the field of clutches for selectively engaging and transferring power from motors and flywheels to drive shafts.

BACKGROUND OF THE INVENTION

Portable sewing machines are well known in the art. An example of such a portable sewing machine is described in U.S. Pat. No. 6,499,415, which is incorporated herein by reference.

The traditional portable sewing machine is a machine with an attached motor. The motor drives the main drive shaft of the machine through a power transmission system, such as a system of gears, or drive belts. There are many drive shafts in a sewing machine. With regard to this invention, the main drive shaft is the shaft that extends out of the sewing machine housing and is available for power transmission to the internal components of the sewing machine. In the machine described in the above referenced patent, and described herein, the motor drives the main drive shaft of the machine by transmitting power by a drive belt attached to a balance wheel, also known as a flywheel, which is connected to the main drive shaft. In the examples shown, the belt is a toothed belt, to improve traction and prevent slipping. Thus, it is through the flywheel that rotational force is exerted upon the main drive shaft to operate the components of the sewing machine, allowing the machine to perform a sewing function.

Although the examples shown herein use a toothed belt to drive the flywheel, one skilled in the art will recognize that other mechanisms may be used to drive the flywheel, such as a smooth belt, gears, or direct friction contact between the power shaft of the motor and the flywheel. In addition to driving the sewing components of the sewing machine, the flywheel is also used in the bobbin winding operation of the machine. The flywheel should be able to be disengaged from the main drive shaft in order to allow for bobbin winding without turning the main drive shaft. A bobbin is familiar to those skilled in the art and is the housing for the lower thread on a lockstitch sewing machine. The sewing machine usually offers a feature located on the top or front of the sewing machine to allow convenient winding of thread onto the bobbin. The structure generally used for bobbin winding includes a spindle on top or on the front of the machine onto which the bobbin is placed. The spindle includes a wheel which when selectively displaced to engage a surface of the flywheel, causes the spindle to rotate when the flywheel rotates. The rotation of the spindle also causes the bobbin to rotate, allowing thread to be wound onto the bobbin. An alternative to this arrangement is an independent bobbin winder which engages the drive belt. The spindle's wheel is then selectively displaced to engage a surface of the belt, causing the spindle and flywheel to rotate.

When the machine is engaged in the bobbin winding operation, it is beneficial to have the flywheel disengaged from the main drive shaft of the sewing machine. This allows the bobbin winding operation to take place without the other components of the sewing machine operating. This reduces wear and tear on the other components of the sewing machine as they do not unnecessarily operate when not performing the sewing function. If the bobbin winding is to take place while a fabric work piece is in the machine, it is also desirable to disengage the flywheel from the main drive shaft of the sewing machine to keep the needle from punching multiple holes in the fabric while winding bobbins. In other words, this feature eliminates the need to remove the fabric work piece when winding bobbins. Since the wheel for bobbin winding engages the flywheel or drive belt, one way to prevent the operation of the sewing machine during the bobbin winding operation is to disengage the flywheel from the main drive shaft. This will allow the flywheel to rotate freely, as driven by the drive belt, on the shaft without causing a rotation of the main drive shaft itself. This results in the ability to wind a bobbin without the machine operating (i.e. performing the sewing function). To operate the machine again (perform the sewing function) the flywheel must be re-engaged with the main drive shaft of the machine.

The traditional way to engage and disengage the flywheel is to use a compression clutch. Such a compression clutch is shown in FIG. 2. The compression clutch of the prior art generally includes a number of components. Included in the compression clutch assembly is a bushing 1 which fits over the main drive shaft that extends from the housing of the sewing machine. The bushing 1 is secured to the main drive shaft by a roll pin 2. The roll pin 2 fits through an aperture 3 present in the side of the bushing 1 which positively attaches bushing 1 to the main drive shaft which has a similar aperture. Bushing 1 includes a central aperture 4 which is threaded for receipt of a clutch knob 5. A flywheel 6, including a central aperture 7 sized to fit over a portion of bushing 1, includes a transmission surface 8 for engaging a drive belt 9. The drive belt 9 is connected to a motor, not shown, to drive the flywheel 6, and hence the main drive shaft of the sewing machine. The compression clutch has, to date, been a flat washer 10 with prongs 11*a-e* on the inner and outer edges of the washer 10. The two inner prongs 11*a* and *b* are bent away from the surface of the flat washer 10. The inner prongs 11*a* and *b* then act like leaf springs. When pressure is applied to a clutch knob 5, which threads into the end of the main drive shaft's bushing 1 of the sewing machine, the threaded knob makes contact with the two inner prongs 11*a* and *b* of the washer 10 which then in turn forces the flywheel 6 against the flange of the bushing 1 on which the flywheel 6 turns. The washer 10 is restricted from rotation while tightening the clutch knob 5 as the two inner prongs 11*a* and *b* rest in two notches at the outer end of bushing 1. Notches 16*a* and *b* are roughly half the depth of washer 10 so that the leaf springs can still appropriately create friction when compressed. The friction created is the engaged orientation of the clutch, the main drive shaft and flywheel are engaged and rotate as one. Tightening the clutch knob 5 further, increases the friction and results in less likelihood that the flywheel 6 will slip on the bushing 1. To disengage the clutch the clutch knob 5 is loosened which relaxes the two inner prongs 11*a* and *b* and reduces the friction. The outer prongs 11*c-e* are in the proximity of a stop screw 12 in the face of the clutch knob 5. Once the screw 12 comes in contact with one of the outer prongs 11*c-e*, the clutch knob 5 can no longer turn. This keeps the clutch knob 5 from coining off, or unthreading itself, as the flywheel 6 is powered by the motor in the disengaged position.

This design is not without its drawbacks. When sewing one or more layers of fabric together, needle penetration power is directly related to how positively the flywheel 6 is secured to the main drive shaft and its end bushing 1. Should the flywheel 6 slip, the needle of the sewing machine would likely hit the surface of the fabric to be penetrated and stop. This situation can be annoying and slows sewing progress. The result is often the urge to try and fling the flywheel 6 to force the needle's entry. Alternatively the clutch knob 5 can be further tightened which sometimes works. But, by over tightening the clutch knob 5 it also becomes much more difficult to loosen for bobbin winding. Additionally, further tightening of the clutch knob 5 increases the likelihood that the clutch will not slip when needed, resulting in the unnecessary breakage of the internal parts of the sewing machine.

The solution to the problems of the sewing machine clutch described above is a removable locking pin to replace the compression clutch. The removable locking pin of the present invention functions to mechanically link the bushing 1 or the main drive shaft to the flywheel. The removable locking pin may also function as a shear pin to allow free rotation of the flywheel with respect to the main drive shaft should the main drive shaft encounter resistance sufficient to cause breakage of internal parts.

SUMMARY OF THE INVENTION

A sewing machine having a locking pin clutch mechanism allowing the user to selectively engage the flywheel or balance wheel for transmitting power to the main drive shaft. The locking pin may also have a line of weakness to function as a shear pin. The locking pin may be removable from the flywheel, and the flywheel retaining locking knob may include an aperture for storing the locking pin. In alternate embodiments, the locking pin may be held captive in the flywheel when the clutch is disengaged In other embodiments, the sewing machine can be described as including a main driveshaft, a bushing attached to the main drive shaft, the bushing having a flange, a flywheel selectively engaged with the bushing, the flywheel providing rotational force to the main driveshaft when engaged to the bushing by a locking pin inserted into an aperture in the flange and an aperture in the flywheel when the apertures are aligned, the flywheel being free to rotate with respect to the main driveshaft when the locking pin is removed from the aperture in the flange.

Further, the invention need not be limited to sewing machines, but can be applied to other mechanisms requiring power transfer to a drive shaft.

DETAILED DESCRIPTION OF PREFERRED EMBODIMENT

Figure 1:
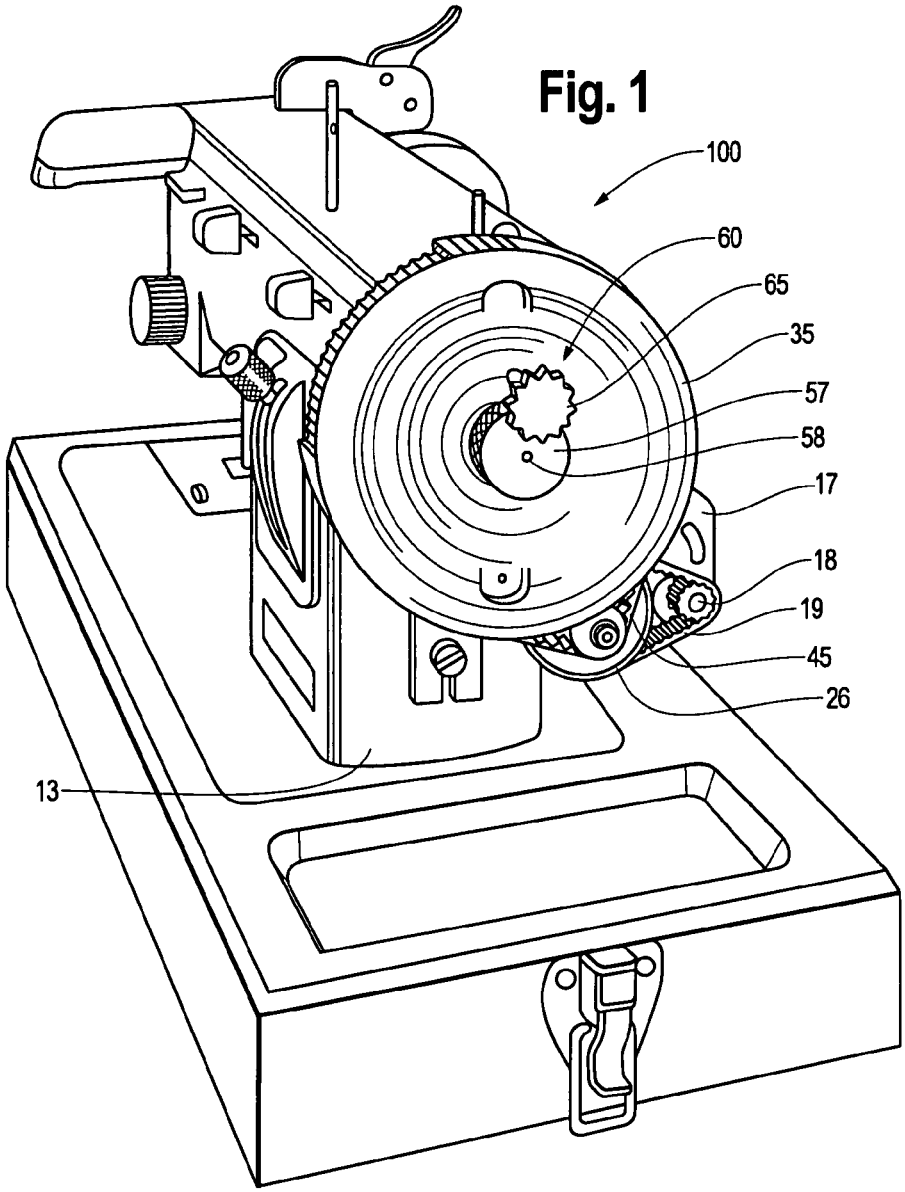
FIG. 1 is a perspective view of the sewing machine.
Figure 2:
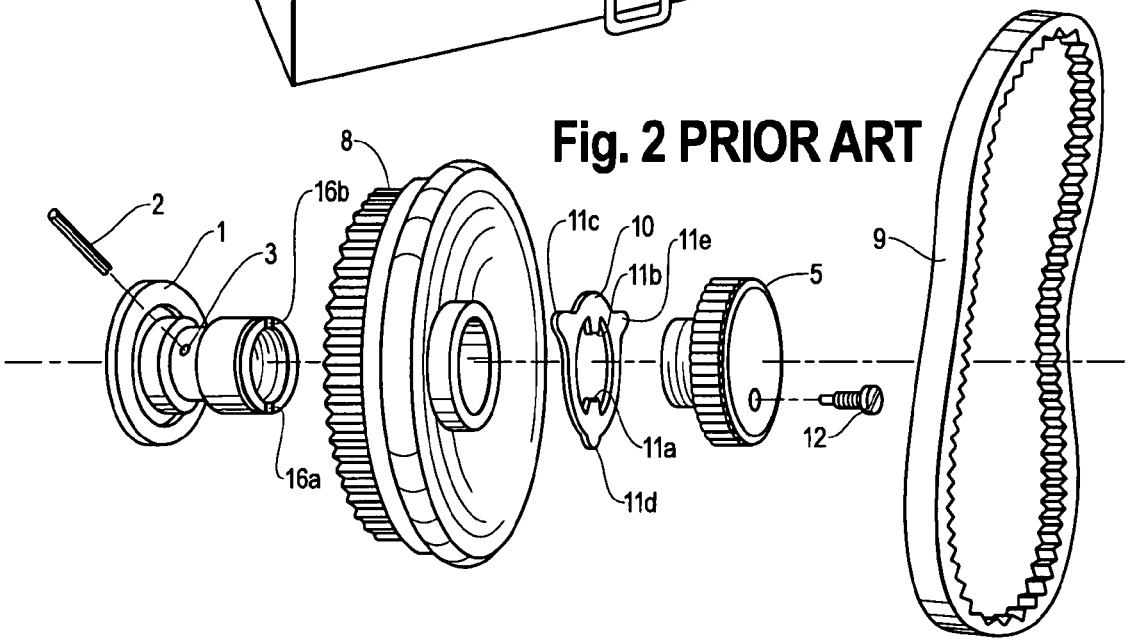
Fig. 2 PRIOR ART
FIG. 2 is an exploded view of a compression clutch of the prior art.
Figure 3:
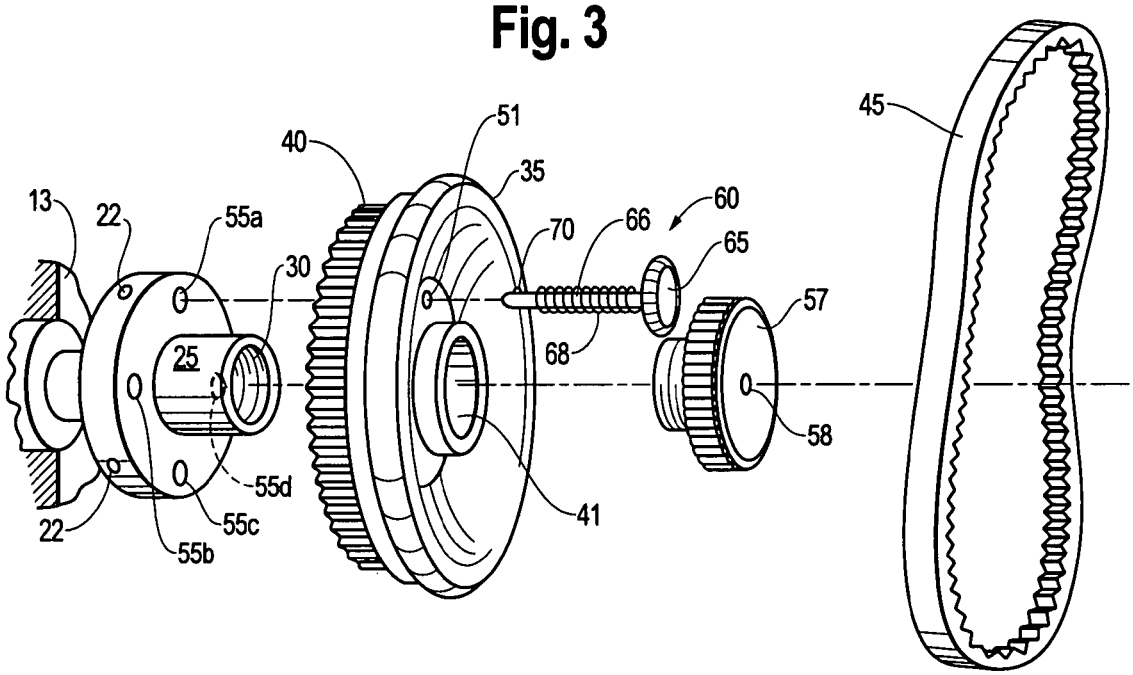
FIG. 3 is an exploded view of a flywheel including a removable locking pin.
Figure 4:
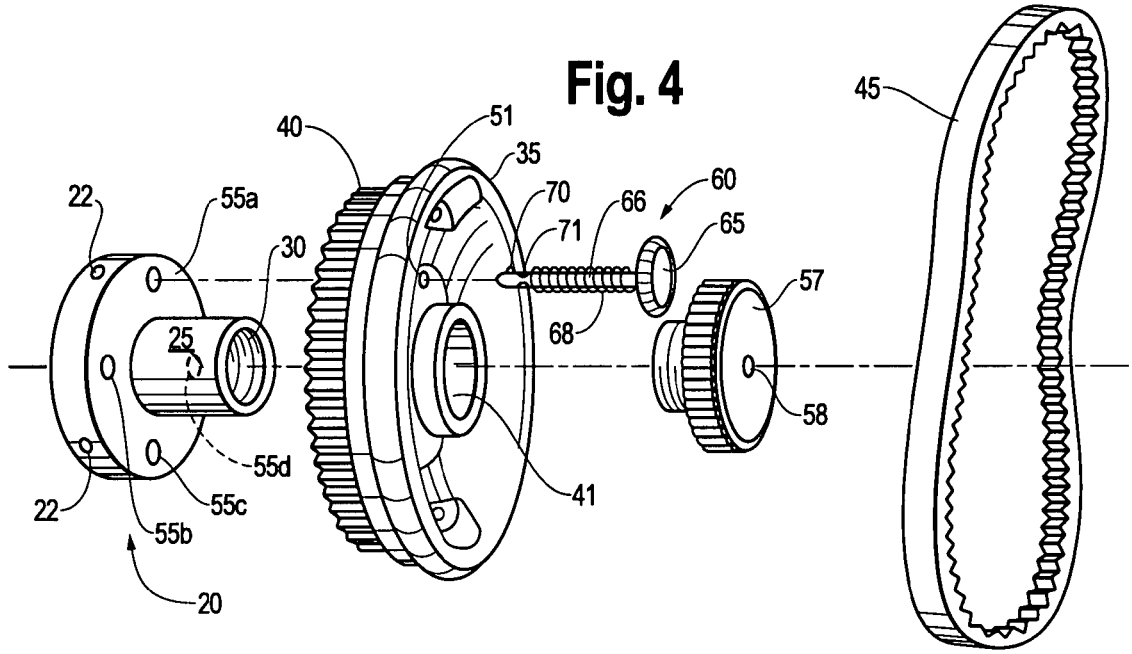
FIG. 4 is an exploded view of a flywheel including a removable locking pin.
Figure 5:
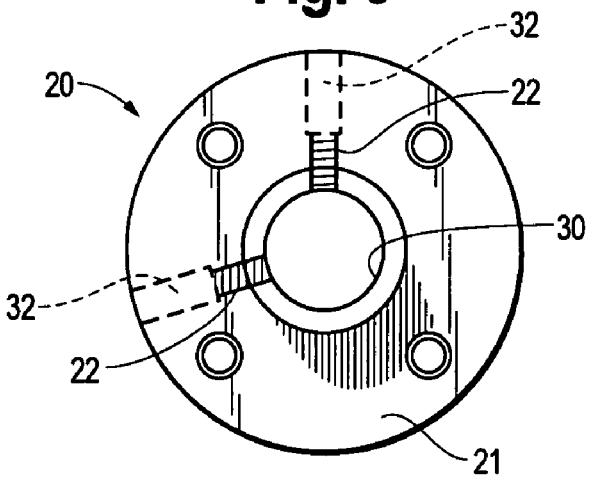
FIG. 5 is a front elevation engineering schematic showing details of a bushing for use with the invention.
Figure 7:
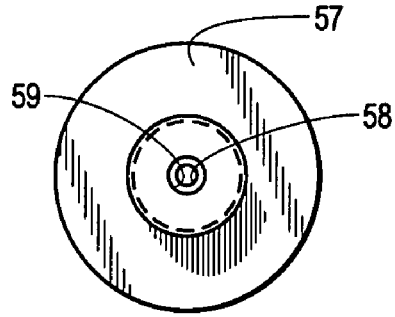
FIG. 7 is a front elevation schematic drawing of a retaining knob including an aperture for storing a locking pin.
Figure 6:
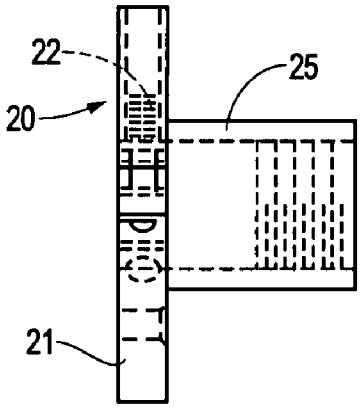
FIG. 6 is a side elevation engineering schematic showing details of a bushing for use with the invention.
Figure 8:
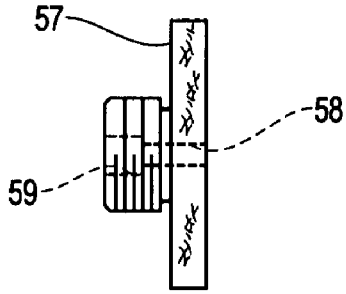
FIG. 8 is a side elevation schematic drawing of a retaining knob including an aperture for storing a locking pin.
Figure 9:
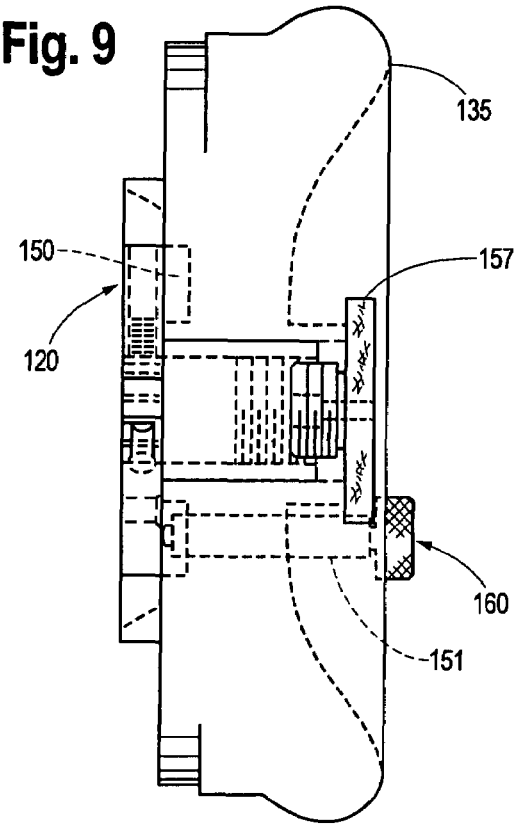
FIG. 9 is an assembled side view of the components of FIG. 9.
Figure 10:
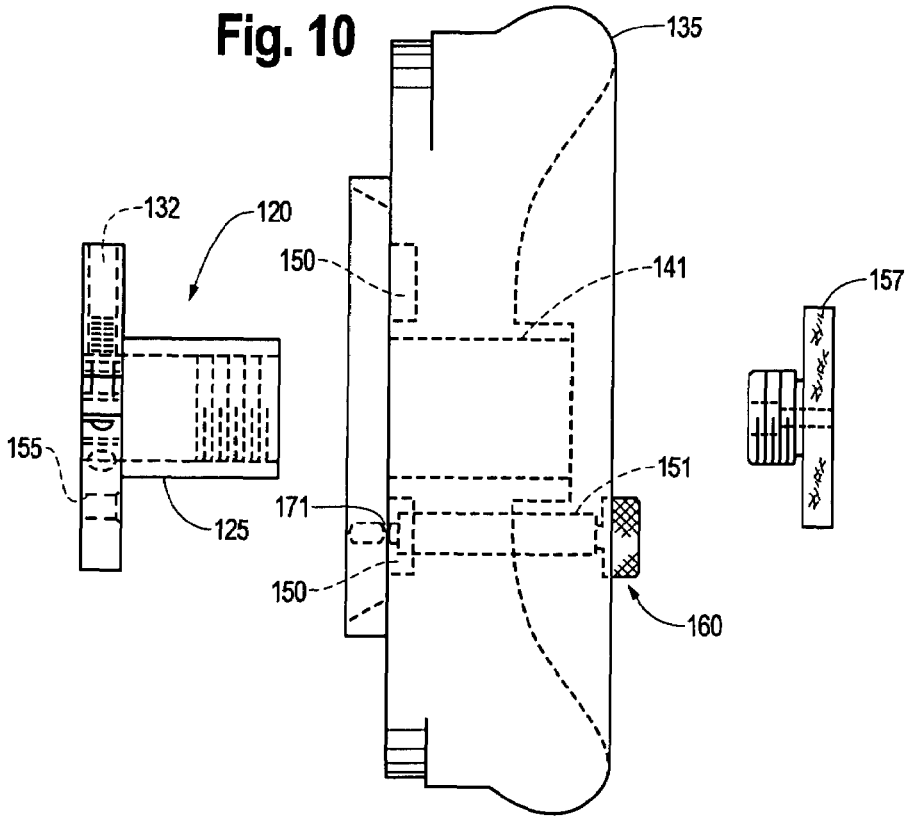
FIG. 10 is a side elevation exploded diagram showing a bushing, flywheel, retaining knob, and captive pop pin locking pin of the invention.

The invention described herein is for use with a portable sewing machine. However one skilled in the art will recognize that the invention described herein will also work for many systems which use a flywheel or other rotating member to drive a drive shaft. While the sewing machine described herein includes an attached motor, the invention described herein will work equally well if the flywheel is driven by an external motor, or a motor that is not attached to the sewing machine. Such external or unattached motors are common in industrial sewing machines.

With reference to FIGS. 1 and 3-8, the sewing machine 100 includes a housing 13 from which a main drive shaft 15 extends therefrom. A motor 17 having a power shaft 18 is used to drive a belt 19 to rotate a reduction pulley 26 which in turn drives belt 45 to rotate flywheel 35. A bushing 20 is placed about the exposed main drive shaft 15 and prevented from rotating about the main drive shaft 15 by at least one set screw 22. In the preferred embodiment, two set screws 22 are used to secure the bushing 20 the main drive shaft 15. One skilled in the art will recognize that the bushing 20 is not a necessary part of the invention. For instance, the main drive shaft 15 could incorporate a flange proximal to the housing 13, where the flange would permit engagement of a removable locking pin.

The bushing 20 includes a flange portion 21 and a narrower portion 25 of reduced diameter in comparison to the diameter of the flange portion 21. In the preferred embodiment, the set screws 22 are secured through the flange portion 21. The flange portion 21 includes apertures 32 extending from its outer perimeter to its central aperture 30 to accept the set screws 22. The bushing 20 is placed over the main drive shaft 15 so that the flange portion 21 is proximal to the main housing 13 of the sewing machine 100. This positioning allows the flywheel 35 to be placed over the narrower portion 25 of the bushing 20. Flywheel 35 is generally of a larger diameter than the flange portion 21 of the bushing 20.

The flywheel 35 includes a drive surface 40 on which the drive belt 45 engages. In the preferred embodiment, the drive surface 40 includes teeth to engage a toothed drive belt 45. One skilled in the art will recognize that a toothed drive belt 45 is not necessary, and a smooth drive belt, or other friction type drive can be used. The flywheel 35 includes a central aperture 41 sized to fit over the reduced portion 25 of the bushing 20. The flywheel 35 includes a locking pin aperture 51 extending therethrough generally parallel to the central aperture 41 of the flywheel 35, the flywheel locking pin aperture 51 is located radially away from the flywheel's central aperture 41.

The bushing 20 includes at least one corresponding locking pin aperture 55, positioned on the flange portion of the bushing 20, so that said locking pin aperture 51 is align when the flywheel 35 is placed upon the narrower portion 25 of the bushing 20. In the preferred embodiment, the bushing 20 includes four such locking pin apertures 55*a-d*, the locking pin apertures being equally spaced about the flange 21 of the bushing 20. As one skilled in the art will recognize, the bushing 20, and the flywheel 35 may have a plurality of such locking pin apertures 51.

The assembly also includes a retaining knob 57 which threads into the central aperture 30 of the bushing 20. The retaining knob 57 holds the flywheel 35 onto the bushing 20, while allowing the flywheel 35 to freely rotate about the bushing 20. The retaining knob 57 preferably has a diameter smaller than that of the flange portion 21 of the bushing 20. In alternate embodiments, the retaining knob 57 can thread directly into the main drive shaft 15.

The retaining knob 57 includes an pin holding aperture 58, which is used to hold the locking pin 60 when the locking pin 60 is not being used to hold the flywheel 35 and bushing 20 in an engaged relationship. The pin holding aperture 58 includes a portion of greater diameter 59 located away from the head of the retaining knob. The portion of greater diameter 59 allows the detent ball 70 to secure the locking pin 60 into place while not allowing the locking pin 60 to extend too far outside of the retaining knob on the side proximate to the machine housing 13. If the locking pin 60 were to extend too far, it could interfere with the drive shaft when a separate bushing 20 is attached to the main drive shaft 15.

When the flywheel is rotated so that any locking pin aperture 51 in the flywheel 35 is aligned with a locking pin aperture 55 in the bushing 20 a locking pin 60 can be inserted to secure the two together, thus allowing the flywheel 35 and bushing 20 to rotate together. This creates a direct drive situation whereby the flywheel 35 can not slip on the bushing 20. Then to disengage the flywheel 35 from the bushing 20, the locking pin 60 is removed from the apertures.

The locking pin 60 is stored in a pin holding aperture 58 in the center of the clutch or retaining knob 57. In this position the locking pin 60 does not engage or make contact with the bushing 20 so the flywheel 35 is free to rotate with respect to the main drive shaft 15, keeping the machine from operating (i.e. performing the sewing function).

The locking pin 60 includes a head 65 and a shaft 66. The locking pin 60 is preferably a detent pin with a spring 68 over the body of the shaft 66. The spring 68 is contained by the head 65 which is most preferably a thumb nut, and detent ball 70 at the opposite end of the locking pin 60. The spring 68 functions to hold the detent ball 70 against the surface of the bushing 20 to keep the locking pin 60 from moving in and out of the locking pin apertures once it is pushed into position. This eliminates potential rattling noises and also keeps the locking pin end from colliding with the sewing machine head casting or housing 13 in the proximity of the bushing 20.

The locking pin 60 also functions as a shear pin. The locking pin has a shaft tip end 90 opposite the head 65. In the preferred embodiment, the locking pin 60 has the following specifications:

- 3/16" diameter 18-8 stainless steel pin.
- A shear groove 71 or other line of weakness is 0.26" toward the pin's head 65 from the inside edge of the detent ball 70.
- Diameter at the shear groove 71 is 1/8".
- Length of pin from inside edge of detent ball 70 to inside end of head 65 is 1.5".
- Diameter at detent ball 70 is 0.204"
- Length of pin from inside edge of detent ball 70 to tip end 90 is 0.20".

One skilled in the art will recognize that these dimensions are merely preferred dimensions, and may vary with the specific application. For instance, the shear groove 71 may not be positioned 0.26 inches from the inside edge of the detent ball 70 of the shaft 68. The shear groove 71 should be positioned so that the groove is near the interface between the bushing flange portion 21 and the flywheel 35. In such a position, the shear groove 71 will function and break if sufficient force is applied between the flange 21 and the flywheel 35, such as when the motor is driving the flywheel 35, and the drive shaft 15 stops or is slowed by heavy fabric in the sewing mechanism, or other such obstruction.

Maximum power is achieved by using a flywheel 35 of greater diameter with an appropriate hole in the face of the wheel for the insertion of the pin 60 described above. However, flywheel 35 diameter changes are not necessary to reap the benefits of the direct drive system described.

One skilled in the art will recognize that placement of the locking pin apertures 51 and 55 can vary. However, placement of the locking pin apertures can be limited by design constraints of the sewing machine. For instance, the flange portion 21 of the bushing 20 can be as large as the flywheel 35. However if the flange portion 21 becomes too large in diameter, the flange portion may interfere with the bobbin winding wheel. Thus, in most applications, the flange portion 21 is of a diameter less than the flywheel 35. In other applications, it may be desirable for the retaining knob 57 to be larger than shown in the drawings. In such an application, the retaining knob 57 may include a locking pin aperture so that the locking pin can be inserted into the locking pin aperture in the retaining knob 57 and also through the locking pin apertures in the flywheel 35 and flange portion 21 of the bushing 20. In such an arrangement, the locking pin 60 will lock the retaining knob, flywheel 35, and flange portion 21 together so that they would rotate in unison.

The above invention can also be used on industrial and commercial sewing machines which are either portable or non-portable. For instance, a sewing machine in a powerstand (table with motor mounted under the table) can make use of the locking pin clutch described herein. Most of these machine types do not have a bushing attached to the upper drive shaft. In fact, they rarely have any clutch system at all. The flywheel is mechanically attached to the bare metal shaft end (main drive shaft). The intention is to have positive drive to the main drive shaft at all times with no slippage possible. Adding the clutch system allows for the same direct drive connection but enhances the operation by allowing for easy disengagement of the flywheel by dislodging the pin connecting the flywheel to the bushing. As previously described, the bushing may be unnecessary, if the drive shaft includes a flange portion, or other structure which allows insertion of a pin connecting the structure to the flywheel 35. The addition of a locking pin as described here on such an industrial sewing machine also adds the added functionality of a replaceable shear pin. In addition, the shear pin makes bobbin winding more convenient and it protects the machines internal parts from breakage.

The sewing machine clutch with a removable locking pin as described herein can also be constructed to include a captive locking pin. Such an alternate embodiments is shown in FIGS. 9 through 13. The sewing machine includes a flywheel 135 having a flywheel locking pin aperture 151 and a bushing 120, substantially as described in the previous embodiment, the bushing 120 including a flange portion 121 and a narrower portion 125. The flange portion 121 includes at least one bushing locking pin aperture 155. As in the preferred embodiment described previously there may be a plurality of bushing locking pin apertures. In the captive pin embodiment being described, the locking pin 160 remains in the flywheel locking pin aperture 151 when the locking pin 160 is disengaged from the bushing locking pin aperture 155. When the locking pin 160 is retained in the flywheel locking pin aperture 151, but not in the bushing locking pin aperture 155, the flywheel 135 is free to move about the bushing 120. The side of the flywheel 135 proximate to the bushing flange portion 121 can be dished at the flywheel locking pin aperture 151, thereby creating a void 150 between the flywheel 135 and the bushing flange portion 121. The void 150, may extend annularly about the flywheel central aperture 141, or merely extend annularly about the flywheel locking pin aperture 151. In either case, the void 151 provides space for a retracted captive locking pin, particularly in the case of keyed locking pin, or a detent pin. Additionally, the void 151 provides an added area of tolerance then the locking pin 160 includes a shear groove 171 to allow the locking pin to act as a shear pin as well. A void 150 may also be used with a pop pin, or any other locking pin consistent with the functionality of the invention.

Figure 12:
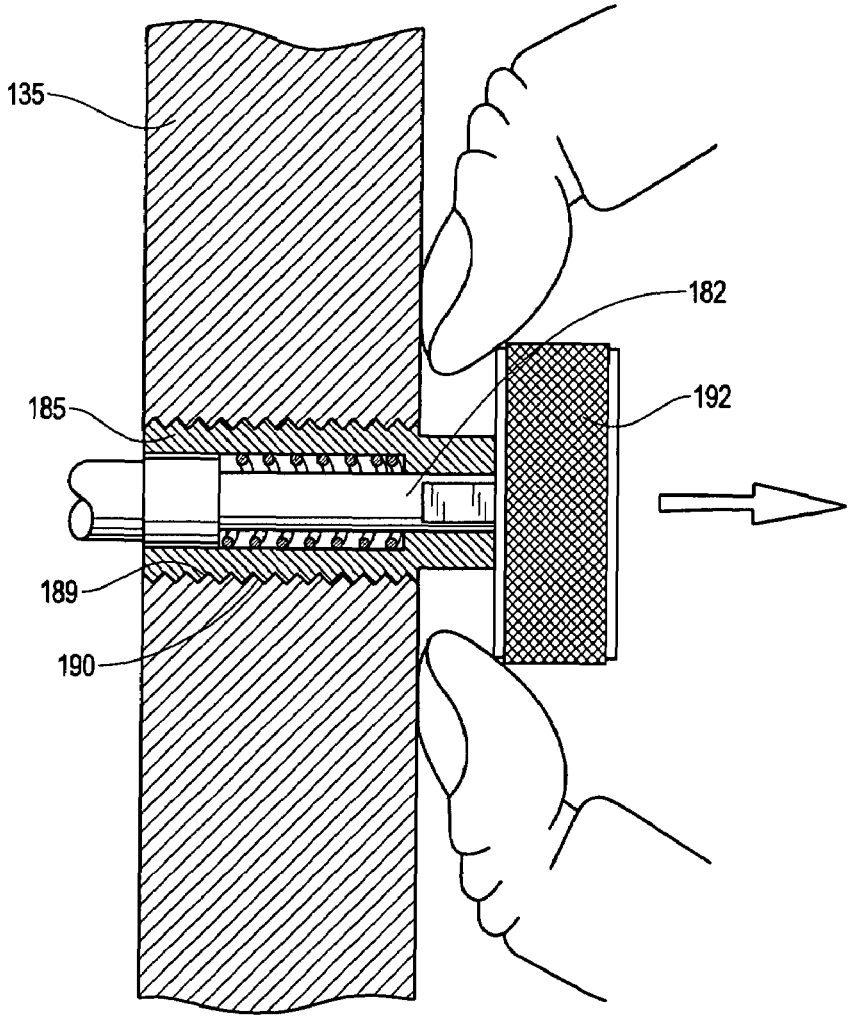
FIG. 12 is a side cross sectional view of a pop pin in a flywheel with the pin extended.
Figure 13:
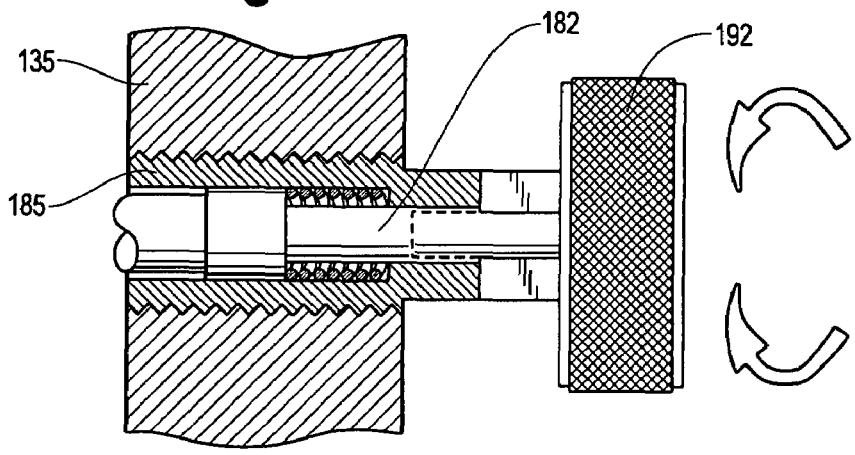
FIG. 13 is a side cross sectional view of a pop pin in a flywheel with the pin retracted.

The locking pin 161 for an embodiment including a captive locking pin is preferably a pop pin 180 (also known as a clamp pin or hand retractable plunger), as shown in FIGS. 12 and 13. Such a pop pin 180 is available from Carr Lane of St. Louis, Mo., with reference to part number CL-4-HRP-S, although other types with similar functionality may be used. As shown in FIGS. 12 and 13, the pop pin 180 typically includes a spring-loaded pin 182 which travels inside a boss 185. The boss 185 is affixed is the flywheel locking pin aperture 151 by corresponding threads 189 and 190. The pop pin 180 may be fixed or attached into the flywheel locking pin aperture 151 by any number of ways, such as being welded, screwed or threaded into the flywheel locking pin aperture 151, or even molded or milled directly into the design of the flywheel 135. As with all of the locking pins for use with the machine described herein, the pop pin may include a shear groove 171, or other line of weakness.

The spring loaded pin 182 includes a hand actuated knob 192 which when manipulated by a user will retract the spring loaded pin 182 into the boss 185. This action of retracting the spring loaded pin 182 also retracts the spring loaded pin from the bushing locking pin aperture 155, so that the bushing 120 and the flywheel 135 are free to rotate relative to one another.

Figure 11:
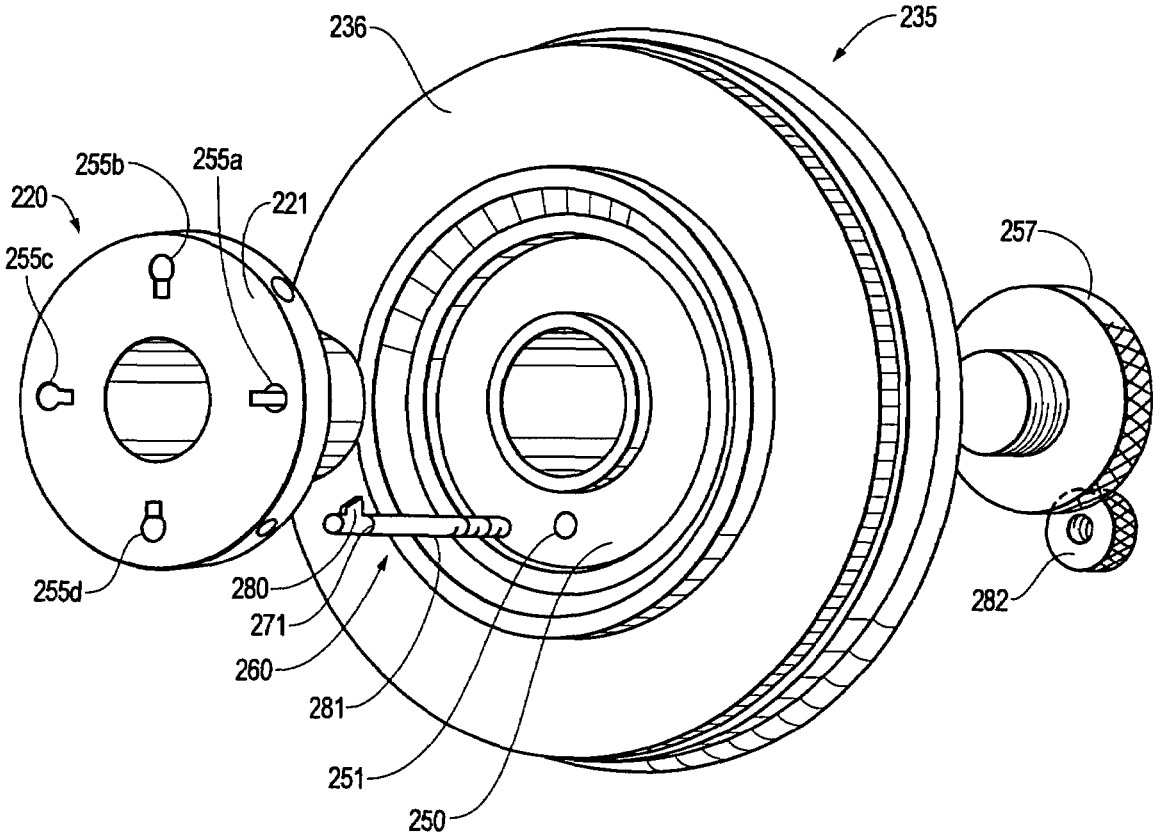
FIG. 11 is a side elevation exploded diagram showing a bushing, flywheel, retaining knob, and captive keyed locking pin of the invention.

Another embodiment of the invention may use a keyed locking pin 260, having a tab or key 280 extending from the shaft 281 of the locking pin 260, as shown in FIG. 11. Such a locking pin engages an aperture 255 of bushing 220, the aperture 255 having a shape to accommodate the tab 280 when the keyed locking pin 260 is inserted into aperture 255. When disengaged from the aperture 255, keyed locking pin 260 is held captive to the flywheel 235 as the tab 280 can not exit the aperture 251 in the flywheel 235. This arrangement requires a void 250 at the surface of the flywheel 235 proximate to the bushing flange portion 221 to allow the keyed end of the keyed locking pin 260 to rotate in an unobstructed manner while the clutch is disengaged.

The aperture 255 of the bushing 220 must be of an appropriate shape to allow for the passage of the keyed locking pin's key end so that the connection between the flywheel 235 and the bushing 220 can be severed by twisting the pin end in a manner that the keyed locking pin's key end is aligned with the aperture shape. Once aligned, the pin can be retracted so that the connection is disengaged. The assembly of the above mentioned components would require that the pin be installed at the back side 236 of the flywheel 235 before the hand actuated knob 282 is installed on the outside of the flywheel 235. This embodiment would work with or without a spring positioned between the knob and the flywheel outer surface. Such as spring would, however, helps to minimize vibration noises and also keep the pin from colliding with the sewing machine head casting or housing 13 in the proximity of the bushing 220.

Another embodiment uses the detent pin as described in the preferred embodiment. However, Instead of storing the pin in a pin holding aperture 58 in the center of the clutch knob 57, the pin can be pulled out just enough to become disengaged from the bushing 20. As with the pop pin and keyed locking pin embodiments, a void at the inside surface of the flywheel must exist to allow the pin's tip end 90 to rotate freely of the bushing 20. The flywheel aperture in the 151 must be of sufficient diameter to allow the pin and detent ball to retract inside the flywheel to a point where the pin's tip end 90 is clear of the bushing 20. Once this position is reached the flywheel aperture 151 must then decrease in diameter to roughly match the pin's diameter keeping the detent from sliding the remaining way through the flywheel 235. Thus, the void need only be as wide at to accommodate the detent ball, and of a sufficient depth to accommodate the detent ball and portion of the tip end 90 extending thereto. This way the locking pin becomes captive but can also be removed by force as in the preferred embodiment, thus becoming a removable locking pin as well.

Another variation is a threaded aperture in the flywheel for a screw pin which makes contact with the surface of the bushing 20 or engages an aperture 55 in the bushing 20 as the screw pin is advance or retracted by turning the screw pin in the appropriate direction.

The examples described here in are merely examples of the invention, and are not meant to be unnecessary limitations upon the same.

The invention claimed is:

1. A system for selectively securing a flywheel to a driveshaft, the driveshaft including a flange having an aperture, the flywheel having an aperture aligned with the flange aperture, the flywheel and driveshaft being held in an engaged relationship by the locking pin inserted into the flange aperture and the flywheel aperture when the apertures are aligned, the driveshaft further including a central aperture for receiving a retaining knob, the retaining knob retaining the flywheel on the driveshaft, the retaining knob including an aperture sized to receive the locking pin when the locking pin is not being used to engage the flywheel and the driveshaft.

2. The claim described in claim 1, wherein the locking pin includes a detent ball.

3. The system described in claim 1, wherein the locking pin includes a shaft having a shear groove.

4. The system described in claim 1, wherein the driveshaft flange is a bushing secured so that the bushing does not rotate relative to the driveshaft.

5. The system of claim 1, wherein the flywheel includes a plurality of apertures.

6. The system of claim 5, wherein the flange includes a plurality of apertures, the apertures being alignable with an aperture on the flywheel.

7. A sewing machine including a main driveshaft having a flange, a flywheel selectively engaged to the main driveshaft, the flywheel providing rotational force to the main driveshaft when engaged to the main driveshaft by a locking pin inserted into an aperture in the flange and an aperture in the flywheel when the apertures are aligned, the flywheel being free to rotate with respect to the main driveshaft when the locking pin is removed, wherein the main driveshaft includes an aperture for receiving a retaining knob, the retaining knob including an aperture for receiving the locking pin when the locking pin is removed from the flywheel aperture.

8. The sewing machine of claim 7, wherein the aperture receiving the retaining knob is threaded to accept threads on a shaft of the retaining knob, the retaining knob screwing into the main driveshaft to retain the flywheel.

9. A sewing machine including a main driveshaft having a flange, a flywheel selectively engaged to the main driveshaft, the flywheel providing rotational force to the main driveshaft when engaged to the main driveshaft by a locking pin inserted into an aperture in the flange and an aperture in the flywheel when the apertures are aligned, the flywheel being free to rotate with respect to the main driveshaft when the locking pin is removed wherein the flange is a bushing placed about the driveshaft and secured to the driveshaft to prevent rotation relative to the driveshaft, and the bushing includes a flange portion and a portion narrower than the flange, the flywheel being placed about the narrower portion.

10. The sewing machine of claim 9, wherein the bushing includes an aperture for receiving a retaining knob, the locking knob securing the flywheel on the narrow portion of the bushing.

11. The sewing machine of claim 10, wherein the locking knob includes an aperture to accept the locking pin when the locking pin is removed from the flywheel aperture.

12. The sewing machine of claim 9, wherein the bushing includes threads corresponding to threads on a retaining knob, the retaining knob secured to the bushing by the threads.

13. The sewing machine of claim 9, wherein the locking pin includes a detent ball to secure the locking pin in the engaged position.

14. The sewing machine in claim 9, wherein the locking pin includes a line of weakness to allow the locking pin to act as a shear pin.

15. The sewing machine of claim 9 wherein the locking pin includes a shaft having two ends, a head located proximal to the first shaft end and a detent ball located proximal to the second shaft end, further including a spring placed about the shaft between the head and the detent ball.

16. The sewing machine of claim 9, wherein the locking pin is made of 18-8 stainless steel and has a diameter of 3/16 ths of an inch.

17. The sewing machine of claim 16, wherein the locking pin includes a shear groove and the diameter of the locking pin at the shear groove is 1/8 th of an inch.

18. A sewing machine including a main driveshaft, a bushing attached to the main drive shaft, the bushing having a flange, a flywheel selectively engaged with the bushing, the flywheel providing rotational force to the main driveshaft when engaged to the bushing by a locking pin inserted into an aperture in the flange and an aperture in the flywheel when the apertures are aligned, the flywheel being free to rotate with respect to the main driveshaft when the locking pin is removed from the aperture in the flange.

19. The sewing machine of claim 18, wherein the locking pin is held captive in the flywheel aperture when the flywheel and bushing are not engaged.

20. The sewing machine of claim 18, wherein the locking pin a pop pin.

21. The sewing machine of claim 18, wherein the locking pin is a key pin.

22. The sewing machine of claim 18, wherein the flywheel includes a void on the surface facing the flange.

23. The sewing machine of claim 18, wherein the locking pin includes a shear groove.

* * * * *